US006323451B1

(12) United States Patent
Stencel et al.

(10) Patent No.: US 6,323,451 B1
(45) Date of Patent: Nov. 27, 2001

(54) PARTICLE SEPARATION SYSTEM USING PARALLEL MULTISTAGE ELECTROSTATIC SEPARATORS

(75) Inventors: John M. Stencel, Versailles; John L. Schaefer, Lexington; James K. Neathery, Lexington; Heng Ban, Lexington, all of KY (US), .; Dennis Finseth, Pittsburgh, PA (US)

(73) Assignee: University of Kentucky Research Foundation, Lexington, KY (US)

( * ) Notice: Subject to any disclaimer, the term of this patent is extended or adjusted under 35 U.S.C. 154(b) by 0 days.

(21) Appl. No.: 09/383,348

(22) Filed: Aug. 26, 1999

(51) Int. Cl.[7] ..... B03C 7/00
(52) U.S. Cl. ..... 209/127.1; 209/12.2; 209/137
(58) Field of Search ..... 209/12.2, 127.1, 209/128, 129, 130, 132, 136, 137; 55/342.1, 349

(56) References Cited

U.S. PATENT DOCUMENTS

| | | | |
|---|---|---|---|
| 1,071,354 | 8/1913 | Schnelle . | |
| 2,245,200 | 6/1941 | Johnson . | |
| 2,813,076 | 11/1957 | Edelman et al. . | |
| 2,813,626 | 11/1957 | Johnson et al. . | |
| 3,477,569 | * 11/1969 | Klein et al. | 209/127.1 X |
| 3,493,109 | 2/1970 | Carta et al. . | |
| 3,638,400 | 2/1972 | Heilmann . | |
| 3,853,750 | 12/1974 | Volsy . | |
| 4,056,368 | 11/1977 | Rozmus . | |
| 4,319,890 | 3/1982 | Teller et al. . | |
| 4,530,291 | 7/1985 | Wysk . | |
| 4,570,861 | 2/1986 | Zentgraf et al. . | |
| 4,588,423 | 5/1986 | Gillingham et al. . | |
| 4,839,032 | 6/1989 | Whitlock . | |
| 4,874,507 | 10/1989 | Whitlock . | |
| 5,193,942 | 3/1993 | Berry et al. . | |
| 5,224,604 | 7/1993 | Duczmal et al. . | |
| 5,570,789 | 11/1996 | Dunn . | |
| 5,746,320 | 5/1998 | Fujita et al. . | |
| 5,755,333 | 5/1998 | Stencel et al. . | |
| 5,885,330 | 3/1999 | Lee . | |
| 5,938,041 | 8/1999 | Stencel et al. . | |
| 5,944,875 | 8/1999 | Stencel et al. . | |

FOREIGN PATENT DOCUMENTS

| | | | |
|---|---|---|---|
| 1036388 | 8/1983 | (RU) . | |
| 503595 | * 2/1976 | (SU) | 209/12.2 |

OTHER PUBLICATIONS

E.G. Kelly et al., "The Theory of Electrostatic Separations: A Review, Part II Particle Charging," Minerals Engineering, Pergamon Press (Great Britain), vol. 2 (No. 2), p. 193–205, (1989).

(List continued on next page.)

*Primary Examiner*—Tuan N. Nguyen
(74) *Attorney, Agent, or Firm*—King and Schickli PLLC

(57) ABSTRACT

An electrostatic separation apparatus includes of a plurality of separators is provided for separating a particle mixture into two constituent species. Each separator includes one and preferably a plurality of modular separation stages. Each stage of the separator includes a pair of separation subchambers each having an electric field zone for drawing selected charged particles from the particle mixture. A curtain gas flow is provided for each subchamber to entrain and carry the selected charged particles drawn from the particle mixture in the electric field zone to a collector associated with each subchamber for recovery. The inlets for the particle mixture and curtain gas flows are adapted to straighten and smooth the respective flows to reduce turbulence in the separation subchambers and improve separation efficiency. The particle flow remaining after the first separation stage passes through an outlet to a second stage, a recycle line, or if further separation is deemed unnecessary, to a collection device for recovery. The apparatus may include a plurality of single or multistage separators arranged in parallel such that simultaneous operation is possible. Further, the apparatus may be included as part of an overall separation system.

20 Claims, 4 Drawing Sheets

OTHER PUBLICATIONS

T.X. Li, et al., "Dry Triboelectrostatic Separation of Mineral Particles: A Potential Application in Space Exploration," Journal of Electrostatics (No. 47), p. 133–142, (1999).
G. Alfano et al., "Applications of Static Electricity in Coal and Ore Beneficiation," Journal of Electrostatics (No. 16), p. 315–328, (1985).
R. Ciccu et al., "Selective Tribocharging of Particles for Separation," KONA Power and Particle (No. 11) p. 5–16 (1993).
Heng Ban et al., "Dry Triboeletrostatic Beneficiation of Fly Ash," International Ash Utilization Symposium, Lexington, KY (1996).
Thomas L. Robl et al., "Influence of Conversion to Low NoX Combustion on Fly Ash Petrology and Mineralogy:A Case Study," 12th Annual International Pittsburgh Coal Conference, (1995), p. 121–125.
R. Ciccu et al., "Experimental Study on Triboelectric Charging of Mineral Particles," Journal of Electrostatics (No. 23), p. 157–168, (1989).
David R. Whitlock, "Electrostatic Separation of Unburned Carbon from Fly Ash," 10th Annual International Ash Use Symposium, vol. 2: Ash Use Research and Development and Clean Coal By–Products (Jan. 1993).

R. Ciccu et al., "Ore and Coal Processing with the Turbocharger Electrostatic Separator," Advances in Fine Particles Processing, Elsevier Science Publishing Co. p. 427–439, (1990).

Ion I. Inculet et al., "Electrostatic Beneficiation of Coal," Electrostatics and Its Applications, ed. A.D. Moore, Wiley, New York, p. 87–131 (1973).

J.R. Gibbins, et al., "The Origin of Unburnt Carbon in Pulverised Fuel Ash," International Conference on Coal Science, Banff, Alberta, Canada, p. 35–38, (1993).

* cited by examiner 10
24
26
32
38a
38b
26a
26b
28
40
40
35
30a
30b
36a
36b
50
48a
48b
60
69
72a
72b
60a
60b
73
73
58
70b
70a
68
66a
66b
75
74a
74b
81
90a
90b
78
80a
80b
92
92
84a
84b
88a
88b
86
96a
94a
94b
96b
81
96
97

38a
26
38b
39a
39b
28
48a
48b 35
36a
36b
32
50
69a
48a
48b
69
72a
72b
60a
60b 32
38a
38b
26a
26b
28
40
40
30a
30b
36b
36a
35
69a
50
48a
48b
52a, 60a
69
52b, 60b

PARTICLE SEPARATION SYSTEM USING PARALLEL MULTISTAGE ELECTROSTATIC SEPARATORS

TECHNICAL FIELD

The present invention relates generally to the material separation art and, more particularly, to a particle separation system that uses a plurality of multistage separators in parallel to simultaneously separate two species of particles in a highly effective and efficient manner.

BACKGROUND OF THE INVENTION

Various types of apparatus for removing particles from a dry fluid flow using electrostatic separation techniques are well known in the art. An early example of such an apparatus is shown in U.S. Pat. No. 3,493,109 to Carta et al., the operation and limitations of which are described in detail in commonly assigned U.S. Pat. No. 5,755,333 to Stencel et al., issued May 26, 1998. Generally speaking, the Carta et al. patent relies upon turbulent flow and particle-wall contact in the separation chamber to electrostatically charge the particles. The particles are then drawn from the flow by opposed electrically conductive plates having opposite polarities.

While the apparatus proposed in the Carta et al. reference is somewhat effective for separating particles having a selected charge from a particle mixture, several significant limitations remain. For instance, no effective means is disclosed to ensure that once separated, the selected particles will be directed to the appropriate collection device. To the contrary, the apparatus disclosed in the Carta et al. patent promotes turbulent flow in the separation chamber, which can allow deleterious re-mixing of the particles to occur after separation. As should be appreciated, this reduces efficiency to the point that several cycles or passes through the apparatus may be required to achieve separation. In addition to reducing efficiency, multiple passes significantly increase the particle abrasion to which the wall of the apparatus is subjected thereby reducing the service life of the separator.

In an effort to overcome this shortcoming, commonly assigned U.S. patent application Ser. No. 08/726,255, entitled "Apparatus and Method for Triboelectrostatic Separation," proposes an improved apparatus for separating two species of particles from a particle mixture with greater efficiency and effectiveness by using a curtain gas flow to carry the selected particles drawn from the mixture to a collector for recovery. Similar to the apparatus proposed in the Carta et al. patent, separation is effected through the use of oppositely charged conductor plates connected to a variable voltage source. The charged plates attract oppositely charged particles away from the mixture and towards the sidewalls of the separation chamber. The curtain gas flow (which is initially devoid of particles) is then introduced into the separation chamber to provide the cleaning action necessary to remove or sweep the particles from the plates for recovery.

While this apparatus is effective for separating two particle species from a particle mixture, it should be appreciated that further improvements in separation effectiveness and operational efficiency are still possible. More specifically, there is a need for an electrostatic separation apparatus that: (1) reduces turbulence in the separation chamber(s) to ensure that more selected particles are separated from the particle mixture and collected for recovery; (2) includes separators having one or more relatively compact modular separation stages that each include a pair of separation chamber(s) having one or more elongate electric field zones which are capable of handling relatively high flow velocities to allow for an increase in the amount of the particle mixture processed per unit of cross-sectional area; and/or (3) includes a plurality of separators arranged in parallel to ensure that the particle species are fully separated in a single pass to improve operating efficiency and greatly increase the amount of the particle mixture processed in a given time period.

SUMMARY OF THE INVENTION

Accordingly, it is a primary object of the present invention to provide an improved apparatus for electrostatically separating two species of particles from a particle mixture that overcomes the above-identified limitations and shortcomings of the prior art.

Another object of the present invention is to provide a particle separation system including a single distributor for simultaneously supplying a particle mixture to a plurality of parallel separators having at least one separation stage and forming an electrostatic separation apparatus, whereby two distinct and substantially pure particle species are recovered from said apparatus.

Still another object of the present invention is to provide an electrostatic separation apparatus having one or more separators that include multiple separation stages in series that each use curtain gas flows to collect selected charged particles drawn from a particle mixture by an electric field in a separation chamber, whereby after passing the particle mixture through said multiple separation stages, two distinct and substantially pure species of particles are fully recovered.

Yet another object of the present invention is to provide an electrostatic separator that is adapted to straighten the particle mixture and curtain gas flows to reduce turbulence in the separation chamber and improve separation efficiency.

A further object of the present invention is to provide an electrostatic separator having a separation chamber divided into first and second separation subchambers each having an electric field zone for simultaneously separating selected charged particles from a stream of a particle mixture flow.

Still a further object of the present invention is to provide a modular separation stage for use alone or in a multistage separator that effectively separates higher feed rates of a particle mixture per unit of cross-sectional area of the separator than heretofore possible.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, a particle separation system is described that includes an electrostatic separation apparatus. In the broadest aspects of the invention, the electrostatic separation apparatus includes one or more parallel separators having at least one, and preferably a plurality of modular electrostatic separation stages. Each stage is designed to handle a higher feed rate of a particle mixture flow than previously possible by handling a relatively high flow velocity (>10 m/s) and having separation chamber(s) with greater horizontal cross-sectional areas. Dual simultaneous processing of the particle mixture flow in each stage is also made possible by a center partition that divides the separation stage itself in two. This partition thus creates dual streams of the particle mixture for delivery to first and second subchambers in each separation stage. Each subchamber includes a relatively short and narrow electric field zone created by pairs of elongate parallel conductor plates. Selected charged particles drawn from the mixture in each subchamber by the electric field are entrained by a curtain gas and carried away for recovery, while the remaining dual streams of particle flow are passed on to the next-in-line separation stage for further processing. Advantageously, by simultaneously processing dual streams in a rapid fashion through multiple stages, a high feed rate is achieved. Even though each stage may only remove a small percentage of the selected charged particles because of the relatively short and narrow separation zone, separation efficiency is not compromised because of the use of a large horizontal cross sectional area and processing across multiple stages. In effect, each stage merely "skims" a small percentage of the selected charged particles from the mixture. Thus, by simultaneously passing a particle mixture flow through a plurality of the multistage particle separators of the present invention arranged in parallel, the overall amount of particle mixture passed through the separation apparatus in a given time period can be greatly increased.

Preferably, each modular separation stage is rectangular in shape having a narrow width, relatively short length, and a long depth or transverse dimension. Each stage includes at its uppermost portion a first inlet that receives a particle mixture entrained in a dry driving fluid, such as air, from an inlet header or feeder line connected to a distributor or distribution manifold. The distributor/distribution manifold, inlet header, and the uppermost portion of the inlet all encourage turbulent flow, which promotes particle-particle and particle-wall contact that generates a differential charge on the two constituent species of particles present in the mixture prior to delivery to the separation chamber.

The downstream portion of the first inlet is divided into two channels by a center partition. The center partition serves to divide the particle mixture flow such that each of the channels receive a separate stream of the flow. The channels preferably have identical cross-sectional configurations and dimensions, and most preferably are at least 4 inches in length and are relatively narrow. Such a construction tends to reduce and/or eliminate any large scale turbulence created upstream in the inlet or during delivery of the particle mixture to the inlet.

Downstream of the channels is a separation chamber that is also divided into first and second subchambers by the center partition. Each subchamber includes an electric field zone for drawing particles having a selected charge from the particle mixture flow. Specifically, a center conductor plate is provided on or forms a part of the center partition and parallel plate-like conductors are provided in or on the outer walls of each separation subchamber. Each of the plates is elongate and extends the entire depth of the separation stage. The center and outer parallel plates are maintained at voltage potentials so as to create a uniform electric field zone. The dual leads of a voltage source are connected to the conductor plates to control the polarity of the voltage applied to each. A variable voltage source may also be used to permit adjustments to be made to the magnitude of the voltage supplied to each conductor plate.

To remove or sweep the selected charged particles drawn from the particle mixture by the electric field zone in each subchamber and towards the outer conductor plates, a flow of curtain gas is provided for each subchamber. Specifically, a pair of curtain gas inlets supply a curtain gas flow to the first and second separation subchambers. The inlets are separated from the channels forming the inlets by a pair of outer partitions, which are actually the outer walls of the inlet channels. Upon exiting the curtain gas inlet, the flow of curtain gas enters the respective subchamber, entrains the particles drawn from the mixture toward the outer conductor plates, and carries them to a first collector associated with each separation subchamber for recovery.

To improve separation efficiency, each curtain gas inlet preferably terminates in the same horizontal plane as the channels formed in the particle mixture flow inlet and is provided with flow straighteners. This ensures that the curtain gas entering each separation subchamber is smooth and substantially parallel to the particle mixture flow exiting each channel. Advantageously, the smooth, parallel flows of the particle mixture and curtain gas keep turbulence at a minimum and improve the separation efficiency in each subchamber. Additionally, the flows of the curtain gas are preferably metered to ensure that they can be controlled relative to the particle mixture flow upon entering the separation subchambers. As should be appreciated, the parallel, smooth flows and matched velocities can prevent deleterious re-mixing of the separated particle species entrained in the curtain gas and those remaining in the particle flow after separation. Moreover, this flow pattern ensures that each curtain gas flow remains effective in carrying away the selected charged particles drawn from the particle mixture by the electric field zones in each subchamber to the respective collectors for recovery.

As noted above, a first pair of collectors is provided for recovering the selected charged particles entrained in the curtain gas. One of the pair of collectors is associated with each separation subchamber and is preferably an elongate, tube-like structure that extends along the separation stage and into a first collection manifold. In the preferred embodiment, the first collection manifold discharges the recovered selected charged particles to a transition tube that carries them to a first collection device for recovery. A transition outlet downstream of the first separation stage delivers the particle flow remaining after passing through the first separation stage to a next-in-line modular separation stage, or alternatively, to either a recycle line or a second collection device if further separation is unnecessary or undesired.

In accordance with a more specific object of the present invention, a plurality of the modular separation stages of the type described above may be included in each separator. More specifically, the particle flow remaining after the selected charged particles are recovered in the first separation stage is delivered through the transition outlet to a second separation stage. The second separation stage includes a second inlet that is also divided into a pair of channels by a second center partition. Each channel receives the remaining particle flow exiting from the upstream subchamber, which may still contain selected charged particles not separated and carried away as the flow passed through the first separation stage. Preferably, as with the first separation stage, the channels are relatively long (four inches or greater) and narrow, thereby serving to straighten and smooth the particle flow as it passes therethrough.

Upon exiting the second inlet, the particle flow enters a second separation chamber divided by a second center partition into first and second subchambers. In the preferred embodiment, the upper portion of the second center partition includes a notch that interfits with a projection on the lower portion of the first center partition to interconnect the modular stages. Each subchamber forming the second separation chamber includes a second electric field zone for drawing any remaining selected charged particles from the remaining particle flow. The second separation chamber may be substantially identical in construction to the first separation chamber, such that the second electric field zone is created by parallel spaced conductor plates associated with each separation subchamber and one or a pair of center conductor plates.

To carry away the selected charged particles drawn from the remaining particle flow in the second separation stage, a second curtain gas inlet is provided for each of the subchambers. Similar to the first separation stage, flow straighteners are positioned in the second curtain gas inlets to ensure that the second curtain gas flows remain substantially parallel to a vertical axis of the separation chamber prior to entering the respective second separation subchambers. Also, a second pair of outer partitions, which are actually the outer walls of the second inlet, keeps the particle flow and curtain gas flows separated.

The second curtain gas flows entrain and carry the selected charged particles removed by the second electric field zones to a pair of second collectors associated with each subchamber for recovery. Preferably, the species of particles collected in the second pair of collectors are the same species that were removed in the first separation stage and carried away in the first collectors. Thus, the second pair of collectors are connected to a second collection manifold to deliver the particles to the same transition tube and eventually to the first collection device. Alternatively, the pair of collectors associated with the second separation stage may be closed off if it is deemed that further processing is unnecessary, but the dismantling of the second or subsequent stages is not desired.

As should be appreciated, a third modular separation stage similar in operation to the first and second stages described above may form a part of each electrostatic separator. Furthermore, each separator may include more than three separation stages arranged serially, depending on the types of particles being separated, the flow rate, the charges created on the particles, and other parameters. The modular design of each separation stage allows for easy assembly/disassembly to add or remove stages as may be necessary or desired.

Preferably, the last separation stage in the separator includes a terminal outlet for discharging the particle flow remaining after the selected charged particles are fully removed to a final collection manifold that carries the particles on to a second collection device. Of course, this flow should be a substantially pure, commercially acceptable product consisting of only a single species of particles. Thus, after processing the particle mixture through the multistage separator, the result is preferably a single species of particles held in the first collection device and a second species of particles held in the second collection device.

In accordance with another more specific aspect of the present invention, a plurality of the electrostatic separators having one or more of the modular separation stages described above may be aligned in a parallel configuration along the distribution manifold and fed thereby to form a separation apparatus. Advantageously, this allows simultaneous separation to occur among multiple separators, which further enhances operational efficiency. In the preferred embodiment, the distribution manifold includes a plurality of discharge ports each corresponding to an inlet header/feeder line above the first inlet of an individual electrostatic separator which may include one or more stages. Ideally, the particle mixture is introduced from the distribution manifold into each inlet header in a turbulent fashion to induce particle-particle and particle-side wall contact which creates the differential charging of the two particle species that is beneficial for particle separation.

As noted above, each separator in the apparatus includes one or more separation stages, each having a pair of collectors for the particle species recovered during separation. The collectors associated with each stage feed to a separate collection manifold in communication with a collection device. Depending on the particular species of particles extracted by each pair of collectors, the collection manifold associated with each stage may be in communication with a transition tube which also receives flow from manifolds in communication with the pairs of collectors of other separation stages.

Yet another more specific aspect of the invention is to include the plurality of electrostatic multistage separators, the distribution manifold and the collection manifolds forming the separation apparatus in a particle separation system. In the preferred embodiment, the system includes a driving fluid source, such as a forced draft fan for blowing ambient air into a feed line supplying the distributor. The driving fluid source is positioned upstream of the distributor and an induction source, such as an induced draft fan, is provided downstream of the first and second collection bins to draw the driving fluid through the system. A feeder is provided in fluid communication with the forced draft fan for supplying the particle mixture to the distribution manifold, which assists in charging the particle mixture and then supplies a portion of the mixture to each of a plurality of electrostatic separators of the type described above. Each separator includes at least one, and preferably a plurality of, separation stages of the type described above. Thus, each stage has a collector associated with each separation subchamber, but parallel stages may share common collectors. The collectors associated with each stage or parallel stages discharge the collected particles to separate collection manifolds, while the particle flow exiting the last-in-line separator is discharged through a terminal outlet to a final collection manifold. The collection manifolds in turn discharge the separated particle species to first and second collection devices, such as cyclone separators or the like for particle recovery. The first and second collection devices are in fluid communication with the downstream induced draft fan to draw the driving fluid, the particle mixture, and the particle flows through the plurality of electrostatic separators and eventually to the appropriate collection device for purposes of particle recovery.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention and, together with the description, serve to explain the principles of the invention. In the drawings.

Reference will now be made in detail to the present preferred embodiment of the invention, an example of which is illustrated in the accompanying drawing.

DETAILED DESCRIPTION OF THE INVENTION

Figure 1:
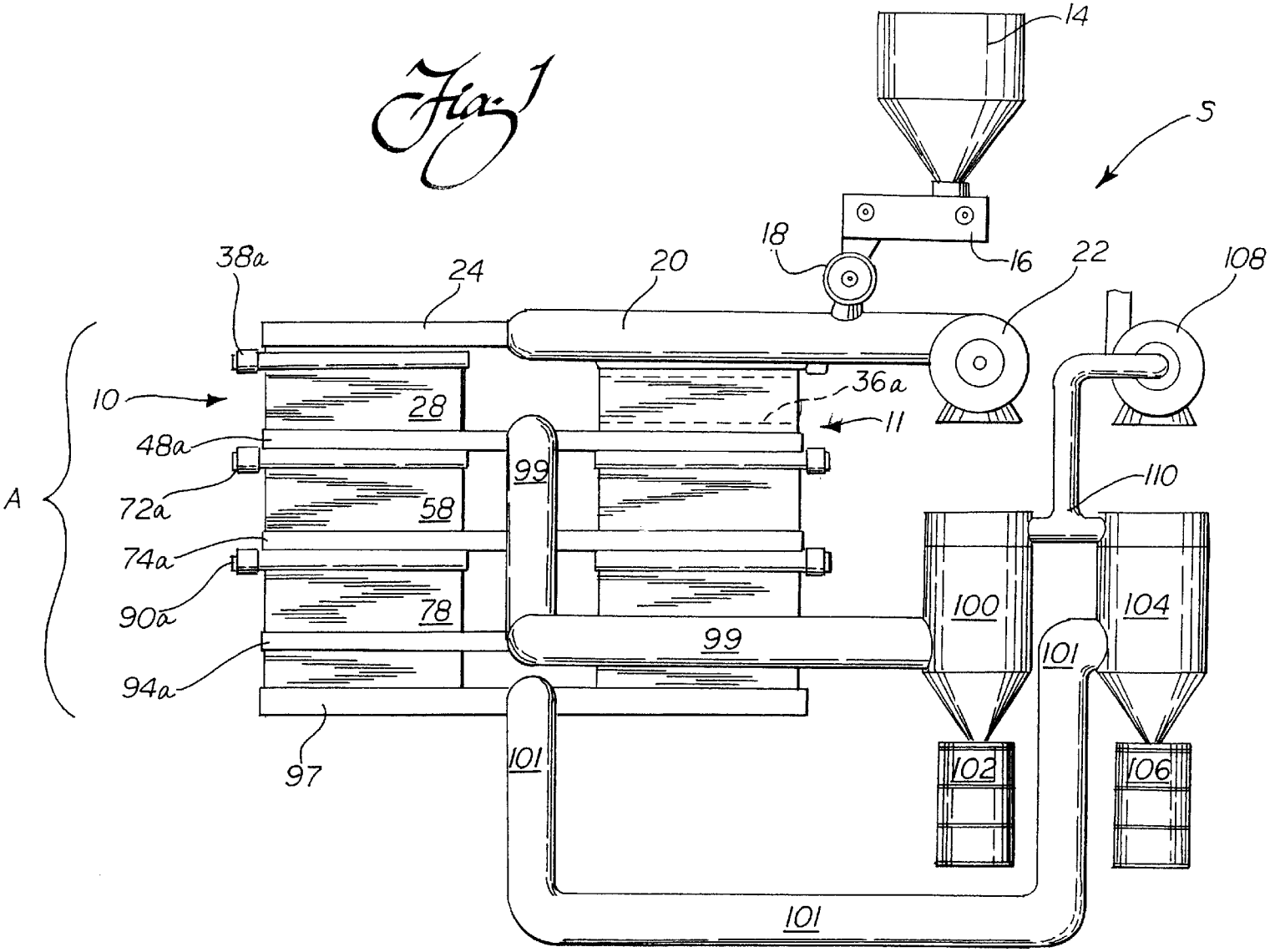
FIG. 1 is a schematic representation of the particle separation system including a separation apparatus comprised of a plurality of multistage electrostatic separators in parallel.

Reference is now made to FIG. 1 showing a particle separation system S including an electrostatic separation apparatus A having one or more electrostatic separators 10. A separator 10 of the type illustrated may, for example, be used in the separation and purification of the mineral matter or pyrite constituents from the carbon constituents in finely-ground coal; ash constituents from carbon in coal combustion ash; specific minerals obtained from fine-sized mineral mixtures; heavy metal or radioactive components which are physically mixed in soils or other materials and ceramics contained in mixtures of ceramics, metals or organic polymers. In all cases, the terms "fine sized" or "finely ground" refer to particles having physical diameters in the range of 500 $\mu$m to approximately 0 $\mu$m and preferably, a diameter smaller than 75 $\mu$m. It should be appreciated that the apparatus A and separators 10 are used for separating dry particles in contrast to wet particles or wet separation systems in which water or some other liquid with or without water is used to effect particle separation.

As shown in FIG. 1, the particle separation system S includes a holding tank 14 for receiving a particle mixture comprising two species of particles (A and B). The particle mixture (A+B) is delivered by gravity from the holding tank 14 to a feeder 16, which in turn supplies metered quantities of the particle mixture through an air lock 18 to a feeder line 20. In the feeder line 20, the particle mixture encounters and is entrained in a driving fluid, such as ambient air, to create a particle mixture flow. In the preferred embodiment, the driving fluid is supplied by a driving fluid source, such as a forced draft fan 22, positioned at the upstream end of the feeder line 20. The fluid or gas is preferably ambient air, but other gases such as nitrogen, helium, argon, carbon dioxide, or combustion flue gas can be used at temperatures between approximately 25° C. to 300° C.

Figure 4:
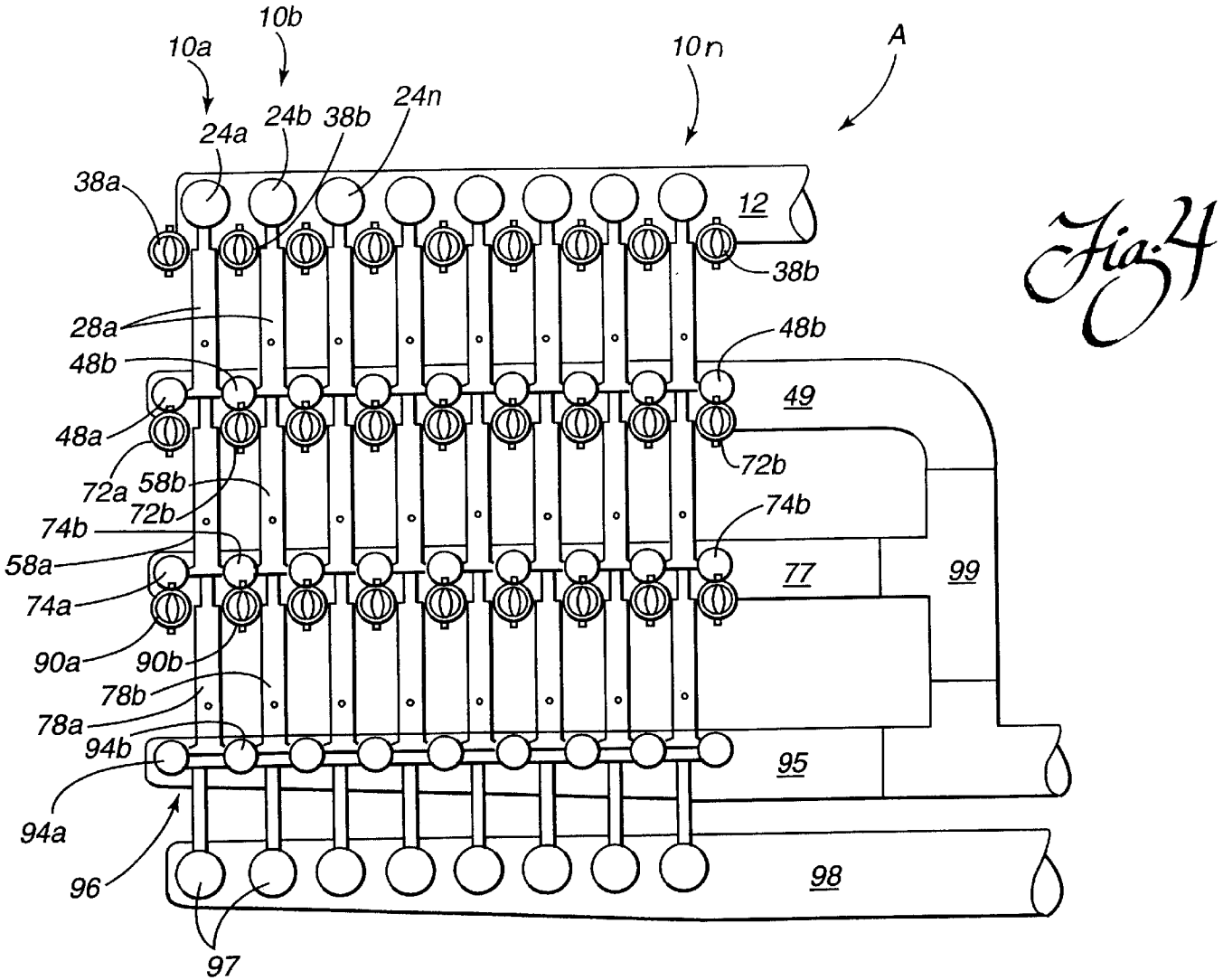
FIG. 4 is a schematic side view similar to FIG. 1, but illustrating several of the multistage separators in parallel along a single distribution manifold and in communication with first, second and third collection manifolds for recovering a first species of particles once separated and a fourth manifold for recovering the remaining species of particles exiting from the last-in-line stages.
Figure 5:
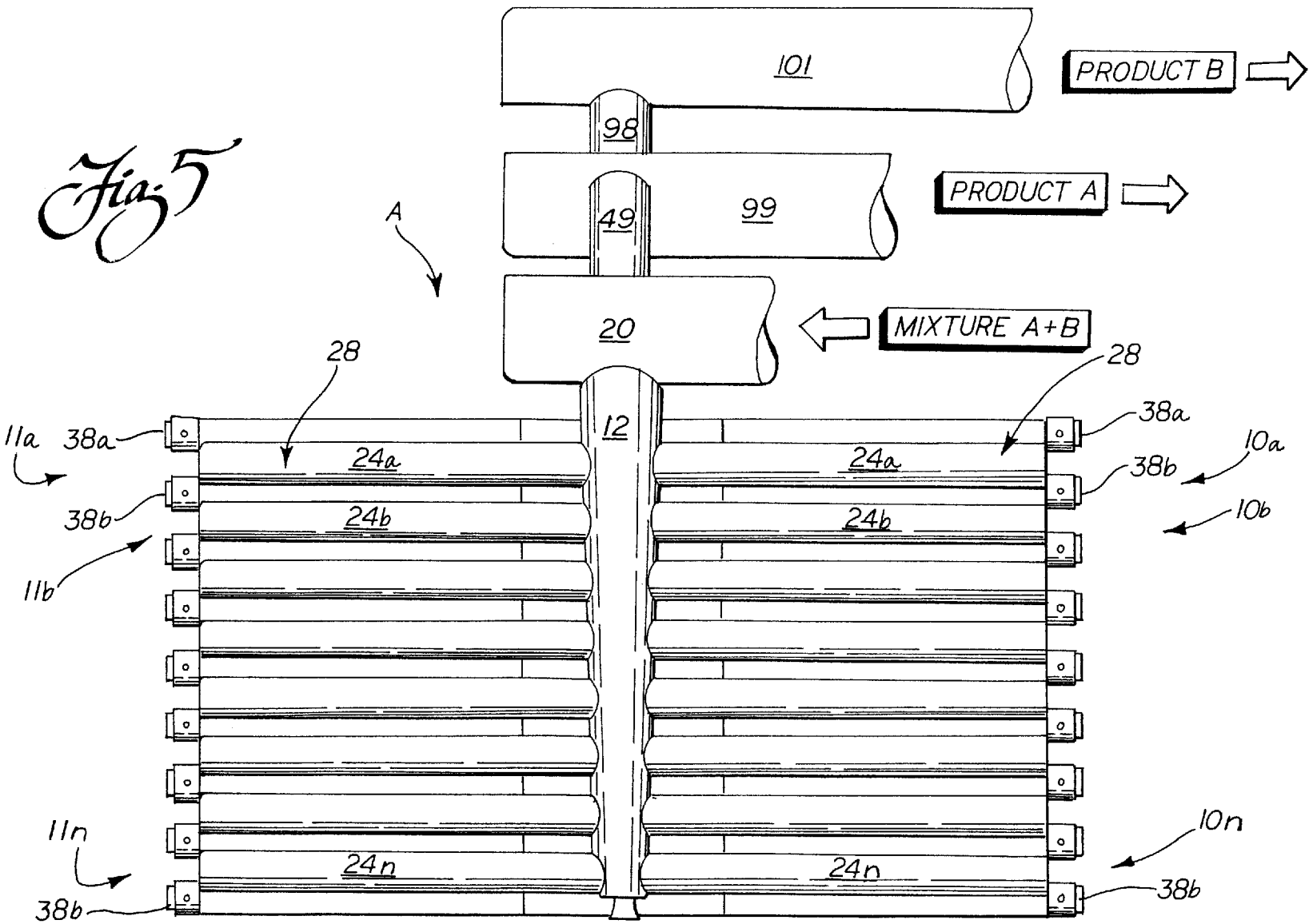
FIG. 5 is a schematic top view similar to FIG. 4, illustrating in particular a separation apparatus where two batteries, each comprised of a plurality of multistage separators, are provided on either side of a single distribution manifold.

The feeder line 20 supplies the particle mixture flow to the distributor line, such as where only one or a pair of parallel separators 10, 11 are provided (see FIG. 1), or to a distribution manifold 12 where multiple pairs of separators are provided in parallel (see FIGS. 4 and 5). The feeder line 20 is primarily where the particle mixture becomes tribocharged prior to entering the individual separators 10. As is known in the art, the extent to which the particle mixture is tribocharged depends on the flow behavior within this feeder line 20. Preferably, to enhance tribocharging, the flow is turbulent to induce particle-particle and particle-wall contact, with the Reynolds Number, $R_e$, greater than 2300 (where $R_e = D \cdot V/\nu$, where D=the characteristic dimension of the feeder line 20, V=the fluid flow velocity, and $\nu$=the kinetic viscosity of the fluid). The feeder line 20 may also be lined with an appropriate dielectric material of a type known in the art to enhance the tribocharging of the particles.

As perhaps best shown in FIGS. 4 and 5, where a plurality of separators 10*a* . . . 10*n*, 11*a* . . . 11*n* are provided in parallel, the distribution manifold 12 includes a plurality of discharge ports connected to inlet headers 24*a* . . . 24*n* that deliver the entrained particle mixture flow to the separators. In the embodiment shown in FIG. 1, the distributor/distribution manifold 12 cannot be seen, but it is in communication with the inlet headers 24 of both separators 10, 11, in a manner similar to that shown in drawing FIGS. 4 and 5. The velocity of the particle mixture/gas flow in each header 24 is preferably at or greater than 10 m/s, but velocities between 1 and 50 m/s may also be employed. Of course, higher velocities impart greater differential charging of the particles by tribocharging action by maximizing the particle-particle and particle-wall collisions. Preferably, the solid/gas mass ratio in the inlet headers 24 leading to each separator 10, 11 is about 1:1, but can vary from between 10:1 and 1:1000. However, if the solid/gas mass ratio is too small, then either the cross sectional area of the separator 10 needed for a high feed rate may become excessively large or the cost/ton to process the particle mixture would be uneconomical.

Figures 2A, 2B, 2C, 3:
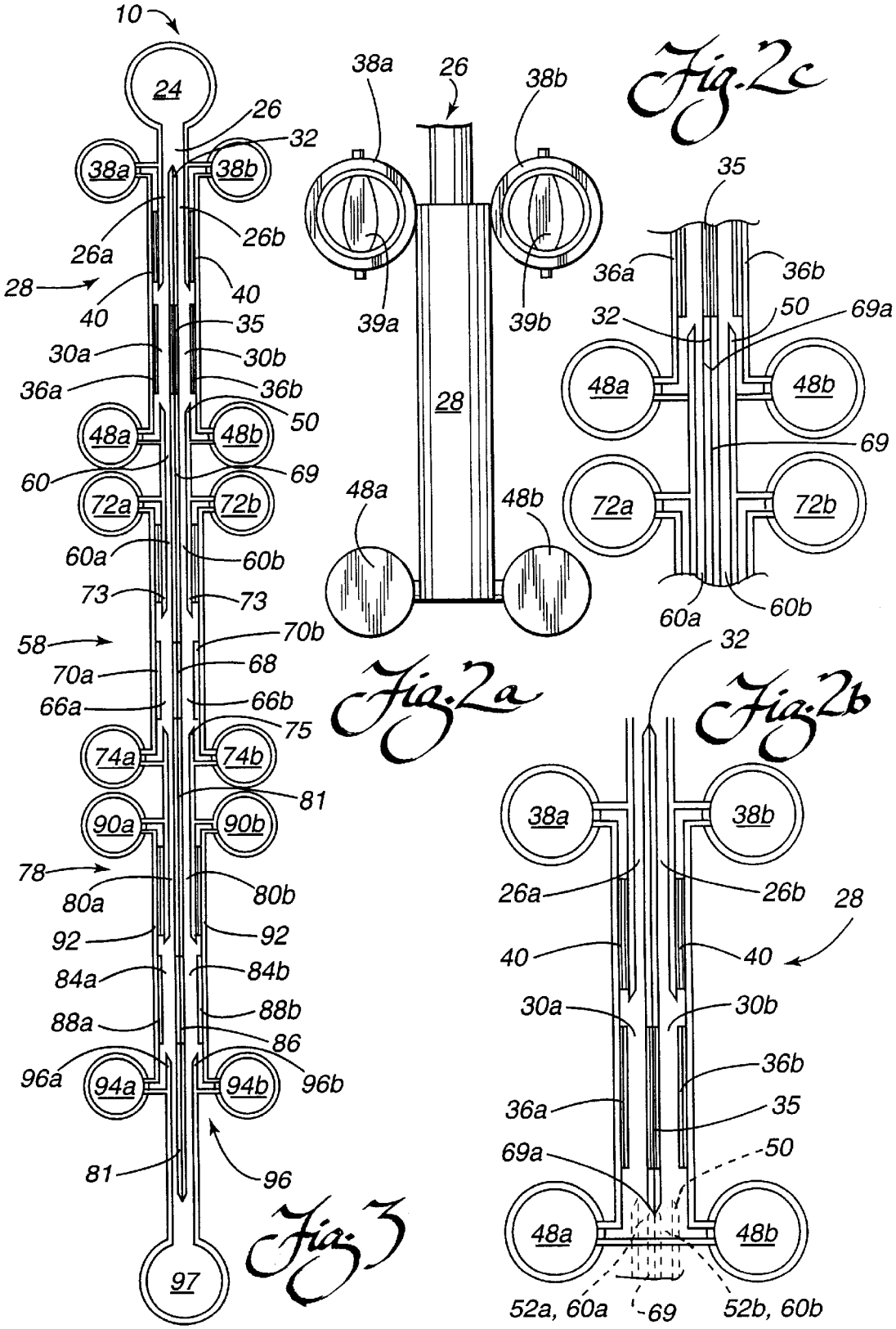
FIG. 2*a* is a side view of a single modular separation stage.
FIG. 2*b* is a cross-sectional side view of a single modular separation stage.
FIG. 2*c* is a cross-sectional side view of two interconnected modular separation stages.
FIG. 3 is a partially schematic, cutaway cross-sectional side view of a multistage separator including first, second, and third modular separation stages in series.

Referring now to FIG. 3, each header 24 delivers the differentially charged particle mixture to a first inlet 26 that forms a part of the first separation stage 28 of each separator 10, 11 or 10*a* . . . 10*n*, 11*a* . . . 11*n*. As illustrated, the inlet headers 24 introduce the particle mixture from the top of the separator 10 or parallel to its axis of symmetry.

With reference to FIGS. 2*a* and 2*b*, the construction of a first stage 28 of the electrostatic separator 10 is illustrated in detail. From the header 24, the particle mixture flows in a turbulent fashion downwardly through the inlet 26 toward a separation chamber that performs the electrostatic particle separation. A center partition 32 extends from the lower portion of the inlet 26 and through the entire separation stage 28, which is preferably rectangular in cross-section. This partition 32 divides the inlet 26 into first and second channels 26*a*, 26*b*, preferably having identical cross-sectional configurations and dimensions. More specifically, the dimensions of each channel 26*a*, 26*b* are as small as 0.20 inch (0.51 cm) in width by 2 inches (5 cm) in depth. The width is variable from approximately 0.2–2.0 inches (0.5–5 cm), while the depth may be varied from approximately 2–84 inches (5–210 cm). Using the smallest dimensions, a particle mixture feed rate as great as 25 lb/hr (approximately 12.5 kg/hr) is possible. Of course, the feed rate of each individual separation stage may be increased by increasing the depth. The length of the channel is preferably between 4–10 inches (approximately 10–25 centimeters). Using these optimum dimensions, the theoretical feed rate/cross-sectional area for each stage is approximately 3600 lb/hr·ft$^2$ (~17,600 kg/hr·m$^2$), which is believed to be greater than any other pneumatic transport, fine particle beneficiation system commercially available or presently under development. The reason for the high feed rate/cross-sectional area is the relatively high velocity (>10 m/s) of the particle mixture as it passes through the stage 28 and the small width of each channel 26*a*, 26*b*.

As the particle mixture flow passes from the inlet header 24 through the inlet 26, the center partition 32 serves to divide it into two distinct streams. As should be appreciated, the individual streams of particle mixture flow are still in a turbulent regime at this point. To remove this turbulence, the channels 26*a*, 26*b* are at least 4 inches long and relatively narrow to ensure that the particle mixture flow has an opportunity to straighten and smooth such that any large scale turbulence created during tribocharging is eliminated. Alternatively, a plurality of flow straighteners (not shown) may optionally be positioned parallel to the axis of flow in both channels 26*a*, 26*b* to ensure that a straight smooth particle mixture flow is created. The flow straighteners may be of any type known in the art, such as a grid or honeycomb-like structure or any other known device that can be used to straighten fluid flow.

As noted above, to provide the desired electrostatic separation of particles having a selected charge from the mixture, a separation chamber is provided downstream of the inlet 26 and channels 26*a*, 26*b*. The center partition 32 serves to divide the separation chamber into two distinct subchambers 30*a*, 30*b*, each having a uniform electric field zone. This electric field serves to draw the selected charged particles from the smooth and straight flowing particle mixture as it enters the respective subchamber 30*a*, 30*b* from the channels 26*a*, 26*b*. In the preferred embodiment, each uniform electric field is created by a conductor plate 35 positioned on or forming a portion of the center partition 30 and parallel conductor plates 36*a*, 36*b* attached to or forming a portion of the side walls of the subchambers 30*a*, 30*b*. The conductors 35, 36*a*, 36*b* are connected to the opposite leads of a high voltage (0–50,000 volt). low current (0–2 mA) voltage source (not shown). Optionally, the voltage source may be variable to adjust the magnitude of the voltage.

Depending on the polarity and strength of the charge supplied to the parallel conductor plates 35 and 36*a*, 36*b*, the particles having an opposite charge will be drawn from the particle mixture by the electric field created. In the illustrated embodiment, for example, the charge on the center conductor 35 may be positive and the plates 36*a*, 36*b* negative. Thus, particles having a positive charge are drawn toward the conductor plates 36*a*, 36*b* upon entering the separation subchambers 30*a*, 30*b*, while the oppositely charged particles are drawn toward and remain near the center partition 32. This separation of particles ensures that the selected charged particles can be removed in an efficient manner, as described further below. Preferably, the length of the electric field zone is between 1–9 inches (approximately 2.5–23 centimeters), but can be varied as necessary to remove a desired amount of the selected charged particles.

As should be appreciated, if the time a particle of component A spends within the electric field zone of each stage is too small relative to the time required for that particle to traverse horizontally across the separation subchamber, it will be transported through the first separation stage 28 and not removed. Because the time a particle resides within the electric field zone or between the high voltage conductors is dependent primarily on the length of the zone and the flow velocity of the particles through the zone, it should also be appreciated that the flow velocity and the extraction zone length and width can be altered to optimize product extraction. For example, with a flow velocity of 10 m/s and an electric field zone length of 7.5 cm, the time available to extract a particle is about 7.5 ms. This time period implies that a particle entering the electric field zone would be required to have imparted on it an instantaneous horizontal velocity toward the outer conductor plates 36*a*, 36*b* of nearly 1 m/s to move from the wall to the collector if the width of each subchamber 30*a*, 30*b* is 0.25 inch (0.635 cm), while if the subchamber was ~0.5 inch (1.27 cm), the corresponding horizontal velocity would be required to be about 2 m/s.

In accordance with an important aspect of the invention, the first separation stage 28 also includes a first pair of curtain gas inlets 38*a*, 38*b* for supplying separate curtain gas flows to each separation subchamber 30*a*, 30*b*. Flow straighteners 40 positioned downstream from the curtain gas inlets 38*a*, 38*b* serve to reduce any turbulence and form a smooth curtain gas flow that is parallel to the straightened particle mixture flow upon entering the separation subchambers 30*a*, 30*b*. Preferably, the flow straighteners 40 take the form of a plurality of narrow tubes having aspect ratios, i.e., the ratio of length to diameter, of greater than 20:1.

As the two previously separate particle mixture flows and curtain gas flows enter the respective separation subchambers 30*a*, 30*b*, preferably in the same horizontal plane, they remain parallel by virtue of the smooth, straightened flow patterns created just upstream in the inlets 26*a*, 26*b* and 38*a*, 38*b*. Moreover, if the ratio of gas flow rates, , where =(particle flow rate/curtain air flow rate), are widely dissimilar, i.e. <0.5 or >3, the flow rate vectors at the leading edge of the electric field zone would be grossly mismatched. This mismatch can lead to turbulent mixing of the particulate in the separation subchambers 30*a*, 30*b*. Hence, it is preferable to constrain to the following values: 0.5≦ ≦3.0. To achieve this condition, the velocity of the curtain gas is preferably matched to that of the particle mixture flow by using metering valves 39*a*, 39*b* or the like, such as is shown in the curtain gas inlets 38*a*, 38*b* in FIG. 2*a*. By doing so, any tendency of the flows to intermix in the separation subchambers 30*a*, 30*b* is minimized, which advantageously reduces turbulence and improves separation efficiency. As a result of the two flows remaining discrete, the selected charged particles in the separation subchambers 30*a*, 30*b* are freely drawn from the particle mixture toward the outer conductor plates 36*a*, 36*b* and become entrained in the smooth curtain gas flow provided along the side walls of the separation subchambers 30*a*, 30*b*. This curtain gas flow then moves straight toward a first pair of collectors 48*a*, 48*b*, where the separated particles drawn toward the plates 36*a*, 36*b* are temporarily collected prior to recovery.

As best shown in FIGS. 2*b* and 3, for a multistage separator, a pair of outer partitions 50 define both the inlets of the first collectors 48*a*, 48*b* and a pair of transition outlets 52*a*, 52*b* that are divided by the center partition 32. These transition outlets 52*a*, 52*b* receive the remaining particle flow exiting from each first separation subchamber 30*a*, 30*b* and transition it to the next-in-line, or second, separation stage 58, which may be identical in construction to the first separation stage 28. As should be appreciated, although the first separation stage 28 may remove all or a substantial amount of the selected particles depending on the size of the electric field zone, the types of particles, the charges, and other factors, it is likely that the remaining particle mixture will include two constituent particle species, thus requiring further separation to recover a substantially pure product.

As shown in FIG. 3, the second separation stage 58 is identical in construction and operation to the first separation stage 28. More specifically, the second stage 58 includes a second inlet 60 that is divided into channels 60*a*, 60*b* by the center partition 32. Both channels 60*a*, 60*b* are narrow and relatively long (e.g., 4 inches) to ensure that the flow remains substantially parallel to a vertical centerline axis of the second inlet 60, which removes any large scale turbulence created upstream of or in the transition outlets 52*a*, 52*b*.

Upon exiting the channels 60*a*, 60*b*, the remaining particle flow enters a second separation chamber including first and second subchambers 66*a*, 66*b* each having a second electric field zone. As with the first separation stage 28, the second electric field zones are defined by a center conductor 68 positioned on or forming a part a second center partition 69 and parallel plates 70*a*, 70*b* positioned on or forming a part of the sidewalls of the subchambers 66*a*, 66*b*. A second pair of curtain gas inlets 72*a*, 72*b* supply curtain gas flows to the subchambers 66*a*, 66*b*, which entrain and carry the selected charged particles removed in each subchamber 66*a*, 66*b* to a pair of second collectors 74*a*, 74*b* for recovery. As in the first stage 28, the curtain gas inlets 72*a*, 72*b* also include flow straighteners 73 to eliminate turbulence. First and second collectors 74*a*, 74*b* are provided adjacent to the partition 75 (which is the inlet of the next-in-line stage) defining the transition outlets 76*a*, 76*b* to deliver the collected particles to a second collection manifold 77 that is identical to the first collection manifold 49 for recovery.

It should be appreciated that each electrostatic separator 10 in the apparatus A may include three or more individual separation stages arranged serially depending on the types of particles being separated, the flow rate, the charges on the particles, and other parameters. Thus, as illustrated in FIGS. 1 and 3, a third separation stage 78 similar in operation to those described above may follow the second separation stage 58 for receiving the remaining particle flow. Specifically, the third separation stage 78 includes a third inlet 80 divided into dual channels 80*a*, 80*b* by a third center partition 81. Upon exiting the channels 80*a*, 80*b*, the dual streams of particle flow enter the respective third separation chamber 84 including first and second subchambers 84*a*, 84*b* each having an electric field zone created by a third conductor plate 86 attached to or forming a part of the center partition 32 and outer conduct plates 88*a*, 88*b* attached to or forming a part of the outer walls of the subchambers 84*a*, 84*b*. A third pair of curtain gas inlets 90*a*, 90*b* both having flow straighteners 92 supply the curtain gas for recovering the selected charged particles. Collectors 94*a*, 94*b* having inlets receive the selected charged particles entrained in the curtain gas. A third collection manifold 95 that is identical in construction to the first collection manifold 49 receives the particles from the collectors 94*a*, 94*b*.

When multiple, in-series stages are used, it should be appreciated that each stage may simply remove a portion of the selected charged particles from the particle mixture, and that this portion can be used to determine the overall amount of selected charged particles remaining after the particle mixture passes through multiple stages. More specifically, if each stage removes approximately y % of the mass, m, of one component, A, of the particle mixture, A+B, the application of x stages will in theory produce a purified component in the outlet of each stage having less of component A by the amount x·y·m(A). Therefore, the mass of the product exiting the outlet of each stage, m(AB), can be expressed as follows:

$$m(AB)=m(A+B)-x\cdot y\cdot m(A)$$

For example, if y=30%, after three (x=3) stages, approximately 90% of components A would be removed from the particle mixture and only 10% of component A would remain in m(AB) exiting the third stage. Of course, through experimentation, it is possible to easily determine the amount of one component A removed by each stage.

A third outlet 96 is also provided, which in the illustrated embodiment supplies the remaining particle mixture exiting the third separation stage 78 to an outlet line 97 for recovery. The upper end of the outlet 96 includes outer partitions 96*a*, 96*b* that define the outlet to the collectors 94*a*, 94*b*. The outlet line 97 of each separator 10 is in turn connected to a fourth collection manifold 98. Thus, the particle mixture is separated into the distinct species, one of which is carried away in the first, second and third manifolds 49, 77 and 95 and the second of which is carried away in the fourth collection manifold 98.

As should be appreciated from viewing FIGS. 2*b* and 2*c*, each rectangular box defining the next-in-line separation stage, such as 58, is connected to the upstream separation stage, such as 28. The center partitions of the second and subsequent stages include a notch 69*a* at the upper end (see FIG. 2*c*) that corresponds to a protrusion on the lowermost portion of the center partition of the prior stage, such as partition 32. This allows for modular construction so that separation stages 28, 58, 78 can be easily removed or added as necessary depending upon the particular application. Thus, it is possible to physically remove any unneeded stages, or alternatively to turn off the power supply and hence the electric field or close off the outlet at the terminal end of each stage. Moreover, by alternating the polarity of the electric field in each stage, it is possible to collect product A in a first stage and product B in a second stage, with each product being delivered to separate collection devices for recovery. It is also possible to use a separator having a single separation stage, with the output particle flow exiting the outlet of the single stage being recycled to the inlet for further processing.

As best understood by viewing FIGS. 1 and 4 together, the first, second and third collection manifolds 49, 77 and 95 receive the selected charged particles recovered by each separation stage 28, 58, 78 and deliver these particles through a common transition line 99 to a first collection device, such a first cyclone separator 100 or similar apparatus (e.g., a bag filter or the like), for removing the particles from the flow of the driving fluid. The substantially pure species of particles is then discharged from the cyclone separator 100 to a holding drum 102 or the like, ready for use.

To recover the particle species discharged by the outlet 96 in the last-in-line separation stage, such as the third separation stage 78 in the illustrated embodiment, a second transition line 101 receives the particles from the fourth collection manifold 98 and delivers it to a second collection device, such as a second cyclone separator 104 or similar apparatus. The substantially pure particle species separated from the driving fluid in the cyclone separator 104 is then discharged to a holding drum 106 or the like, also ready for use.

To assist in drawing the particle flow through the system S, an induction source, such as an induced draft fan 108, is provided most preferably downstream of the cyclone separators 100, 104. In the preferred embodiment, the induced draft fan 108 is connected to a T-shaped induction tube 110 in simultaneous fluid communication with the first and second cyclone separators 100, 104. Thus, the forced draft fan 22, induced draft fan 110 and positive pressure curtain gas inlets 38*a*, 38*b*, 72*a*, 72*b*, and 90*a*, 90*b* operate in concert to insure that particles are efficiently moved through the apparatus.

As referenced at the beginning of the above description, FIG. 4 illustrates a particle separation apparatus A comprised of a plurality of multistage separators 10*a* . . . 10*n* arranged in parallel. In this apparatus A, each separator 10*a* . . . 10*n* includes an inlet header 24*a* . . . 24*n* for receiving the particle mixture from the distribution manifold 12. Each separator 10*a* . . . 10*n* includes first, second, and third stages 28*a* . . . 28*n*, 58*a* . . . 58*n*, and 78*a* . . . 78*n* preferably constructed as described above. Collectors 48*a*, 48*b*, 74*a*, 74*b*, and 94*a*, 94*b* recover the product entrained and carried away by the curtain gas in each separation stage 28*a* . . . 28*n*, 58*a* . . . 58*n*, and 78*a* . . . 78*n* of each separator 10*a* . . . 10*n* and deliver it to first, second and third manifolds 49, 77, and 95 for recovery. As should be appreciated from viewing FIG. 4, in each parallel series of separators 10*a* . . . 10*n* the second of the pair of in-line collectors 48*b* of the first stage 28*a* serves as the first collector 48*a* for the next-in-line parallel separation stage 28*b*, and so on with the last-in line separator 10*n* having a single collector 48*b*. Likewise, the second curtain gas inlet 38*b* serves as the first curtain gas inlet 38*a* for the adjacent parallel separation stage 28*b*, and so on as shown in FIG. 4.

Furthermore, it should be appreciated from viewing FIG. 5 that two batteries of a plurality of parallel separators 10*a* . . . 10*n*, 11*a* . . . 11*n* can be provided on both sides of the distribution manifold 12, such that the degree of simultaneous separation may be increased even further. Of course, although two parallel batteries of eight separators 10*a* . . . 10*n*, 11*a* . . . 11*n* are illustrated, it should be appreciated that this number may be increased or decreased without departing from the principles of the present invention.

In summary, numerous benefits may be realized by employing the concepts of the presently proposed electrostatic separation system S, including an improved electrostatic separation apparatus A comprised of one or more separators 10 having at least one, and preferably three, separation stages 28, 58, 78 for separating two species of particles from a particle mixture. Each separation stage, such as stage 28, is capable of processing a greater amount of the particle mixture per unit of time than heretofore possible because of: (1) the higher feed rate of the particle mixture flow; (2) the greater horizontal cross-sectional area of the separation chambers; and (3) the use of multiple stages in series, which allow each stage to merely "skim" a portion of the selected charged particles from the mixture. Successive skimming by each stage results in the recovery of two substantially pure particle species. Operational efficiency is also enhanced by using a single distribution manifold 12 to supply the particle mixture to a plurality of separators 10*a* . . . 10*n* arranged in a parallel fashion which are thus able to complete simultaneous processing of a large amount of the particle mixture (see FIG. 4). Further enhancements are possible by providing two batteries of multistage separators 10*a* . . . 10*n*, 11*a* . . . 11*n* (see FIG. 5).

The foregoing description of a preferred embodiment of the electrostatic separator 10, apparatus A, and system S of the present invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A modular stage for use in a single or multistage separator for separating electrostatically charged particles from a particle mixture flow entrained in a dry driving fluid, comprising:

a particle mixture flow inlet;

a center partition defining at least two channels in said inlet and dividing said particle mixture flow into at least two streams;

a separation chamber divided by said center partition into first and second separation subchambers each having an electric field zone for drawing selected charged particles from a corresponding one of the at least two streams;

a curtain gas inlet for supplying a curtain gas flow to each of said subchambers for entraining and carrying away the selected charged particles drawn from one of the at least two streams; and a collector associated with each of said subchambers for recovering the selected charged particles entrained in said curtain gas flow.

2. The modular separation stage according to claim 1, wherein each said curtain gas inlet includes flow straighteners, whereby said flow straighteners remove large scale turbulence from said curtain gas flows upon entering said separation subchambers.

3. The modular separation stage according to claim 2, wherein said channels in said particle mixture flow inlet and said curtain gas inlets are substantially parallel.

4. The modular separation stage according to claim 3, wherein said particle mixture flow inlet and said curtain gas inlets terminate in a common horizontal plane upstream of said first and second separation subchambers, whereby any tendency of the particle mixture and curtain gas flows to intermix is reduced.

5. The modular separation stage according to claim 3, wherein said curtain gas inlets further include metering valves to permit a flow velocity of the curtain gas to be selectively adjusted to match a flow velocity of the particle mixture flow, whereby said matched velocities of said curtain gas flows and said particle mixture flows reduce any tendency to intermix.

6. The modular separation stage according to claim 1, wherein said center partition includes a center conductor and said first subchamber is provided with a first conductor parallel to said center conductor for creating a first of said electric field zones and said second subchamber is provided with a second conductor parallel to said center conductor for creating a second of said electric field zones.

7. The modular separation stage according to claim 1, wherein said center partition includes a lower portion that is provided with a projection that corresponds in shape to a notch formed in the upper portion of a second center partition of a next-in-line separation stage.

8. The modular separation stage according to claim 7, wherein said notch is V-shaped.

9. An apparatus for separating electrostatically charged particles from a particle mixture flow, comprising:

a distributor manifold having at least one discharge port;

at least one multistage separator including a first modular separation stage having a first particle mixture flow inlet for receiving a particle mixture flow from said discharge port, a first center partition defining a first pair of channels in said first inlet for dividing said particle mixture flow into at least two streams, a first separation chamber divided by said center partition into a first pair of separation subchambers receiving one of said at least two streams and having an electric field zone for drawing selected charged particles therefrom, a first curtain gas inlet for supplying a curtain gas flow to each of said subchambers for entraining and carrying away the selected charged particles drawn from said particle mixture flow, a first collector associated with each of said subchambers for recovering the selected charged particles in said curtain gas flow, and a first outlet for discharging a remaining particle flow stream associated with each subchamber;

said multistage separator further including a second modular separation stage in series with said first separation stage for receiving the remaining particle flow streams from said first outlet of said first separation stage.

10. The electrostatic separation apparatus according to claim 9, wherein each said first curtain gas inlet includes flow straighteners, whereby said flow straighteners remove large scale turbulence from said curtain gas flows prior to entering said first pair of separation subchambers.

11. The electrostatic separation apparatus according to claim 9, wherein said second separation stage includes:

a second center partition;

a second particle flow inlet divided by said second center partition into a second pair of channels for receiving the remaining particle flow streams from said first and second subchambers of said first stage;

a first separation chamber divided by said second center partition into a second pair of separation subchambers each receiving the remaining particle flow streams from said second pair of channels and having second electric field zones for drawing any remaining selected charged particles therefrom, a second curtain gas inlet for supplying a curtain gas flow to each of said second pair of subchambers for entraining and carrying away the selected charged particles drawn from the remaining particle flow streams, a second collector associated with each of said second pair of subchambers for recovering the selected charged particles entrained in said curtain gas flow, and a second outlet for a second remaining particle flow stream associated with each of said second pair of subchambers.

12. The electrostatic separation apparatus according to claim 11, wherein each said second curtain gas inlet includes flow straighteners, whereby said flow straighteners remove large scale turbulence from said curtain gas flows prior to entering said second pair of separation subchambers.

13. The electrostatic separation apparatus according to claim 9, wherein said at least one separator further includes a third separation stage downstream of said second separation stage.

14. The electrostatic separation apparatus according to claim 13, wherein said third separation stage includes an outlet for discharging a third remaining particle flow to a collection device for recovery.

15. The electrostatic separation apparatus according to claim 9, wherein said second separation stage includes a second center partition having a notched upper portion that corresponds to a lower portion of the first center partition of said first stage, whereby the notch of said second center partition interfits with said first center partition to interconnect said first and second modular separation stages.

16. The electrostatic separation apparatus according to claim 13, wherein the second and third separation stages each includes at least one curtain gas inlet for receiving a flow of a curtain gas for entraining and carrying away the selected charged particles drawn from the remaining particle flow stream in each respective stage.

17. A particle separation system for separating and removing selected electrostatically charged particles from a particle mixture, comprising:

a feeder for supplying the particle mixture;

a pressurized driving fluid source for supplying a driving fluid to entrain the particle mixture supplied by said feeder;

a distributor for receiving the entrained particle mixture from the feeder, said distributor including a plurality of distribution ports;

a separation apparatus including a plurality of parallel separators each connected to one of said plurality of distribution ports, each of said separators including one or more modular separation stages in series, each of said stages including one or more collectors for recovering a species of selected charged particles separated from said particle mixture during each stage and an outlet for discharging a remaining particle flow to a subsequent stage for further processing;

a first collection device for receiving the species of selected charged particles from the one or more collectors for each separation stage;

a second collection device for receiving a particle flow remaining after substantially all of said selected charged particles are removed by said one or more separation stages; and an induction source in fluid communication with said first and second collection devices for drawing the driving fluid through the apparatus.

18. The particle separation system according to claim 17, wherein a pair of collectors are provided at each separation stage, and one of said pair of collectors is the same for an adjacent pair of parallel separation stages.

19. The particle separation system according to claim 17, further including a curtain gas source, and wherein each separation stage includes at least one curtain gas inlet for receiving a flow of curtain gas from the curtain gas source for entraining and carrying the species of selected charged particles to the collector for that stage.

20. The particle separation system according to claim 17, wherein a pair of collectors is associated with each separation stage.

* * * * *